US012662221B2

(12) United States Patent
Schomberg et al.

(10) Patent No.: US 12,662,221 B2
(45) Date of Patent: Jun. 23, 2026

(54) MOVEMENT DEVICE FOR PROGRESSIVE MOVEMENT ON THE SURFACE OF A BODY AROUND WHICH A FLUID PASSES

(71) Applicant: Universität Kassel, Kassel (DE)

(72) Inventors: Thomas Schomberg, Kassel (DE); Florian Gerland, Niestetal (DE)

(73) Assignee: Universität Kassel, Kassel (DE)

( * ) Notice: Subject to any disclaimer, the term of this patent is extended or adjusted under 35 U.S.C. 154(b) by 388 days.

(21) Appl. No.: 18/276,917

(22) PCT Filed: Jan. 24, 2022

(86) PCT No.: PCT/EP2022/051465
§ 371 (c)(1),
(2) Date: Aug. 11, 2023

(87) PCT Pub. No.: WO2022/171421
PCT Pub. Date: Aug. 18, 2022

(65) Prior Publication Data

US 2024/0124108 A1 Apr. 18, 2024

(30) Foreign Application Priority Data

Feb. 12, 2021 (DE) ..... 10 2021 103 313.6

(51) Int. Cl.

| | |
|---|---|
| ***B63B 59/08*** | (2006.01) |
| ***B63B 59/04*** | (2006.01) |
| ***B63G 8/00*** | (2006.01) |
| ***B63G 8/08*** | (2006.01) |
| ***B63G 8/24*** | (2006.01) |

(52) U.S. Cl.
CPC ..... *B63B 59/08* (2013.01); *B63B 59/04* (2013.01); *B63G 8/001* (2013.01); *B63G 8/08* (2013.01); *B63G 8/24* (2013.01)

(58) Field of Classification Search
CPC ..... B63B 59/08; B63B 59/04; B63G 8/001; B63G 8/08; B63G 8/24; B63G 59/08; B63G 59/04
See application file for complete search history.

(56) References Cited

U.S. PATENT DOCUMENTS

2010/0126403 A1* 5/2010 Rooney, III ..... G05D 1/0227 901/1
2020/0115019 A1* 4/2020 Malpede ..... B63H 9/04

FOREIGN PATENT DOCUMENTS

DE 102014204249 A1 9/2015
WO 2006038808 A1 4/2006
WO 2010059195 A1 5/2010

* cited by examiner

*Primary Examiner* — Stephen P Avila
(74) *Attorney, Agent, or Firm* — Dinsmore & Shohl LLP

(57) ABSTRACT

A movement device is for progressive movement on the surface of a body around which a fluid passes, such as a hull, a rotor blade, a rudder, a tubular body or the like. The movement device has a retaining system for adhesion of the movement device on the surface, a traction system for providing a course for the movement device on the surface, and a drive system for driving the movement of the movement device on the surface. The drive system has at least one flow element, around which flow can pass, for interaction with the fluid, such that, for the progressive movement of the movement device on the surface of the body around which the fluid passes, flow energy can be extracted from the fluid passing around it and can be used for driving the movement.

20 Claims, 5 Drawing Sheets

MOVEMENT DEVICE FOR PROGRESSIVE MOVEMENT ON THE SURFACE OF A BODY AROUND WHICH A FLUID PASSES

CROSS-REFERENCE TO RELATED APPLICATIONS

This application is the U.S. National Stage of PCT/EP2022/051465 filed on Jan. 24, 2022, which claims priority to German Patent Application 102021103313.6 filed on Feb. 12, 2021, the entire content of both are incorporated herein by reference in their entirety.

FIELD OF THE INVENTION

The present invention relates to a travel device for movement on the surface of a body flowed around by a fluid, in particular a ship hull, a rotor blade, a rudder, a pipe member or the like, at least comprising a holding system for the adhesion of the travel device to the surface, a traction system for tracking of the travel device on the surface, and a drive system for driving the travel movement of the travel device on the surface.

BACKGROUND OF THE INVENTION

Technical surfaces of bodies flowed around by fluid, in particular ship hulls or, for example, inner walls of pipelines or rotor blades of wind turbines are subject to permanent contamination and wear processes in operative use in interaction with the fluid and/or substances or organisms taken along thereby.

In the case of ship hulls, in particular fouling of the surface disposed below the waterline represents a substantial problem. This process of the unwanted settling of organisms and organism properties, also called fouling, results within a short time in the formation of macroscopic fouling layers that increase the flow resistance of the hulls and in the extreme case cause a non-negligible weight increase of the vessels, which results in a significant increase of the fuel requirement of the vessels.

The use of coatings containing biocides on the surfaces of hulls to avoid fouling is only possible in a very limited manner due to statutory provisions. In shipping practice, mechanical cleaning processes of the hulls are therefore regularly carried out. The vessels are, for example, taken into dry docks for this purpose, which disadvantageously represents a time and cost intensive procedure. Alternatively, cleaning work can be carried out in dock, for example manually by professional divers or by means of cleaning devices or robots that are typically operated as tethered systems from the dock of the respective vessel. Such cleaning measures also undesirably cause long downtimes of the vessels and regulations are additionally in force in a number of regions of the world that prohibit the cleaning of hulls in docks to prevent the introduction of invasive species into the local ecosystem.

It is therefore desirable to carry out the cleaning of hulls while the vessel is underway, preferably on the high seas. A substantially continuous carrying out of the cleaning can in particular permanently inhibit the formation of macroscopic fouling. A continuous cleaning operation is also desirable because effects that are disadvantageous from a technical flow aspect typically already arise significantly after a few days of unimpeded fouling.

Travel devices are known in the prior art for the autonomous or semiautonomous carrying out of cleaning and inspection work on hulls below the waterline while the vessel is underway. The travel devices typically have a magnetic holding system, in particular based on suitably arranged permanent magnets, for adhesion to the surface of the hull. A traction system, for example in the form of wheels, rollers, or chains and the associated drive system are typically based on an electric motor for the fixing of the course on the surface. Rotatable brushes or high pressure water jet nozzles, for example, act as cleaning systems. The energy supply for the drive system and the cleaning system, and optionally for further components such as cameras, sensors, or communication modules, is typically provided by means of an electric cable connection to the deck of the vessel or by means of a storage battery that is taken along.

The use of a cable connection is problematic since there is a risk that the supply cable tangles with flotsam or similar and damage to the travel device consequently occurs. The cable additionally generates a substantial flow resistance so that the maneuverability of the travel device is greatly restricted, in particular at high flow speeds, i.e. fast travel of the vessel. A power supply by means of a storage battery that is taken along has the disadvantage that it has to be comparatively powerful and thus large and heavy to allow a time of use per discharge cycle that is suitable in practice, in particular in operation of the travel device at high flow speeds. The high flow resistance of a supply cable or the great weight of an onboard storage battery require that the pressing force to be applied by the holding system of the travel device has to be very high to ensure reliable adhesion of the travel device to the surface of the hull. This circumstance restricts the usability of such travel devices at high flow speeds.

Document WO 2010/059195 A1 discloses a cleaning robot for cleaning a hull while the vessel is underway, with the robot having turbines that are drivable by the water flow and that are operatively connected to a generator so that an energy supply for driving both the cleaning system and the travel movement of the robot on the hull surface is thereby formed.

SUMMARY OF THE INVENTION

It is the object of the present invention to provide an alternative embodiment of a travel device for movement on the surface of a body flowed around by a fluid, in particular of a ship hull flowed around by water.

This object is achieved starting from a travel device as described herein. Advantageous further developments of the invention are also disclosed herein.

The technical teaching of the invention discloses that the drive system of the travel device has at least one flow body for interaction with the fluid flowing around so that flow energy can be taken from the fluid flowing around for the movement of the travel device on the surface of the body flowed around by the fluid and is usable to drive the travel movement.

The invention here starts from the idea of generalizing the principles of the movement of sailing vessels utilizing the wind, i.e. of air flowing around, and of transferring them to other fluids, in particular water flowing around. The drive system in accordance with the invention is therefore in particular configured for such an interaction with the fluid flowing around such that the travel movement of the travel device is exclusively drivable by means of dynamic buoyancy and/or by means of flow resistance force. The drive system has a suitable flow body on which a resulting flow force, that is composed of the flow resistance force in the direction of flow and of the dynamic buoyancy perpendicular thereto, that acts during a flowing around by the fluid. The drive system is in particular configured such that the flow energy that can be taken from the fluid flowing around by means of momentum transfer onto the flow body for the movement of the travel device is usable for a direct fluid dynamic drive of the travel movement. This represents a significant difference from the prior art of document WO 2010/059195 A1 whose technical teaching is directed to an only indirect use of the removed flow energy such that the flow energy is first converted into electric energy by means of a turbine and is subsequently consumed as drive work by means of an electric motor.

In the drive system in accordance with the invention, the force acting on the flow body is transferred to the travel device and is converted into a targeted travel movement on the surface by means of the traction system. A dynamic buoyancy having a non-disappearing component in the direction opposite the flow can in particular be generated by a suitable setting of the angle of attack of the flow body toward the surrounding flow so that the travel device can also be moved against the flow analogously to the tacking of a sailing vessel to reach a destination head to wind. The travel device is therefore drivable on the surface of the body flowed around by the fluid by means of the drive system to make a travel movement whose direction of travel comprises a significant component, in particular a main component, against the direction of flow of the fluid. Directions of travel having a significant component against the direction of flow are to be understood here as those directions of travel that allow the travel device to travel to a designation disposed downstream within a travel time practical for the respective application, in particular by means of "zig-zag courses" analogous to tacking in sailing. In accordance with the invention, a comprehensive and targeted movement of the travel device on the surface of the body flowed around is thus made possible using, in principle, only kinetic energy taken from the flow by means of momentum transfer.

The travel device in accordance with the invention can thus in particular be configured free of mechanical connections to external drive means and/or external holding means. For example, the cable connections known from the prior art between a cleaning device operating on the surface of a hull and a winch or an operator on the deck of the ship for the appropriate operation in accordance with its intended purpose of the travel device in accordance with the invention are unnecessary.

In the case of a vessel that is underway, the flow is substantially caused by the propulsion of the vessel so that the travel device in accordance with the invention is indirectly fed by the vessel drive. A particular advantage is the possibility of a permanent operation underwater at least as long as the vessel is traveling at sufficient speed to generate a sufficiently fast flowing around. The travel device in accordance with the invention can thus be operated without interruption and can in particular carry out a permanent cleaning of the hull, which always inhibits the formation of unwanted fouling in an early phase. In comparison with travel devices from the prior art with heavyweight storage batteries, the travel device in accordance with the invention can have a substantially lower weight so that the contact pressure required for the adhesion to the hull surface is correspondingly lower. The demands on the performance of the holding system thus advantageously fall and there is additionally a smaller load on the traveled surface that can, for example, have coatings or structures prone to wear.

The drive system preferably has a plurality of flow bodies. A torque can be generated on the travel device in a targeted manner by a suitable arrangement and/or individual settability of the angle of attack of the individual flow bodies toward the surrounding flow and an appropriate maneuverability can thus be ensured.

In an advantageous embodiment of the travel device in accordance with the invention, the flow body is formed as a vane member and the drive system has at least one setting element, with the angle of attack of the vane member in the fluid flowing around being settable by means of the setting element. The vane member forms a planar resistance body with respect to the flow mechanical interaction with the fluid flowing around. It is preferably arranged on the upper side of the travel device, i.e. on the side remote from the surface of the body to be traveled over and preferably projects perpendicularly from it into the flow. The design of the vane member can, for example, have a high similarity with the wing of an aircraft. The angle of attack variable by means of the setting element corresponds to the acute angle between the chord, i.e. the straight connection line, between the front and rear edges in the profile of the vane member and the direction of flow of the fluid flowing around. With large angles of attack of the vane member of up to 90°, the flow resistance dominates and the travel device is displaced substantially in the direction of the flow. With smaller angles of attack, a pressure difference arises between leeward and windward of the vane member, from which the dynamic buoyancy perpendicular to the onflow results. The traction system of the travel device takes up the force portion perpendicular to the direction of travel and the remaining portion of the total force of flow resistance force and buoyancy effects a travel movement with a non-disappearing component against the direction of flow.

The vane member can, for example, be received in a pivotable manner in the region of the front edge at the upper side of the travel device analogously to a fore and aft sail of a sailing vessel that is pivotable about the ship mast by means of the so-called boom.

The drive system can in particular have a plurality of mutually spaced apart vane members with which a respective separate setting element can be associated. The maneuverability of the travel device in accordance with the invention can in particular be improved by means of a plurality of vane members.

The vane member can, for example, have an asymmetrical profile. The shape of the cross-section of the vane member in the direction of flow is called the profile and an asymmetry is present when the profile is not formed with mirror symmetry about the chord. The profile determines the technical flow coefficients of the vane member for instance the buoyancy coefficient, the resistance coefficient, and the torque coefficient and can be adapted to the intended application area of the travel device. The profile of the vane member can, for example, be selected from the types listed in table form by the National Advisory Committee for Aeronautics (NACA). With a drive system having a plurality of vane members, the profiles of the vane members can be configured differently from one another, for example.

In a special embodiment, the vane member has an actively or passively variable profile. So-called "morphing wings" are known, for example, whose profile can be actively adapted to the flow and to the desired buoyancy properties by means of shape variable actuators, so-called MFC actuators, based on microfiber composite materials having piezoelectric fibers. The flexibility and maneuverability of the travel device in accordance with the invention can thereby be further increased. A vane member having passive variability of the profile can be configured, for example, analogously to a fore and aft sail of a sailing vessel in which the cloth adopts a different bulge depending on the course of the vessel and the position of the sail boom.

The travel device, for example, has a planar extent of 0.05 square meters up to 1.5 square meters, with the vane member having a planar extent of 0.02 square meters up to 0.75 square meters. The planar extent of the travel device or of the vane member is to be understood here as the largest cross-sectional area of the respective enveloping body that surrounds the travel device without the vane member or the vane member. Said size indications comprise the dimensions of various travel devices for the initially named application examples, with in particular a ratio of the planar extent between the vane member and the travel device of approximately 2 being appropriate for a use of the travel device on a hull flowed around by water.

In a further embodiment, the flow body is configured as a rotor and the drive system has at least one associated rotor drive, with the Flettner rotor being rotatable by means of the rotor drive. The Flettner rotor is a cylinder that is exposed to the fluid flow and that can be set into rotation about its cylinder axis by the rotor drive. The rotating Flettner rotor generates a dynamic buoyancy transversely to the onflow by the so-called Magnus effect of suction and pressure forces that can considerably exceed the flow resistance in amount at a sufficiently high rotation speed. Flettner rotors are known as vessel drives for interaction with the wind. The drive system of the travel device in accordance with the invention can in particular have a plurality of Flettner rotors, for example each having separate rotor drives. The drive system can furthermore also comprise an appropriate combination of vane members and Flettner rotors.

The flow body can preferably be extendable so that the size of the interaction surfaces that can be flowed around can be set. The flow body can, for example, be extended in the manner of a telescope or, in the case of a vane member, can be able to be rolled out or pulled out. In such an embodiment, the drive system can be adapted to the respectively prevailing flow conditions, in particular to the flow speed, so that the amount of flow energy required for the appropriate movement of the travel device can also always be taken from the flow.

The flow body can furthermore preferably be pivotable so that the vertical angle of the flow body toward the upper side of the travel device is settable. The upper side is typically that side of the travel device that continues from the surface of the body traveled over and on which the flow body is arranged. A pressing force can thus in particular be generated by the settability of the vertical angle of the flow body that provides an adhesion of the travel device to the surface of the body traveled over in addition to the holding system. The vertical angle amounts to 90° in the neutral position of the flow body.

The flow body can further advantageously be able to be folded into a position of minimal flow resistance and/or a position of minimal extent perpendicular to the upper side of the travel device, i.e. such a position in which neither a significant flow resistance force nor a dynamic buoyancy can be generated. Such a position is in particular implemented by a folding down of the vane member and/or of the Flettner rotor flat onto the upper side of the travel device. In such a position, the drive system is practically deactivated and does not contribute to the movement of the travel device. This can be necessary, for example, at an extremely high flow speed to prevent a failure of the holding system or during an operating break of the travel device. At moderate flow speeds, it is, in contrast, typically sufficient for an effective deactivation of the drive system to minimize the angle of attack of the vane member by means of the setting element or to switch the rotor drive of the Flettner rotor to stationary. In an application of the travel device on the surface of a hull, an inwardly folded position of the flow body may be necessary so that a travel section having a very small depth of the waterway or a lock can be passed through by the vessel.

The travel device furthermore preferably has at least one electric machine and at least one storage battery electrically connected thereto, with the electric machine being operatively connected to the traction system so that the electric machine is configured for interaction with the traction system in motor operation and/or in generator operation. The electric machine can, for example, be formed as a brushless electric motor. The traction system is appropriately formed with, for example, wheels, rollers, or chains together with the associated axles, bearings, mounts, and seals.

The motor operation, i.e. a drive of the traction system by means of the electric machine for moving the travel device, can take over an assistance function for the flow mechanical interacting drive system, for example at small flow speeds, directions of travel against the flow, or on changes of direction. In the case of an application on the surface of a hull, the motor operation can also serve the movement above the waterline, in particular when recalling and launching the travel device.

In generator operation, torque from the traction system is fed into the electric machine and is there converted into electric energy that can be transferred to the storage battery for storage. The movement energy of the traction system here originates from the flow energy taken from the flow by means of the drive system in accordance with the invention. The generator operation can also be used for developing a significant braking effect on the travel movement of the travel device.

In addition to the electric machine, the energy stored in the storage battery can also be supplied to further electrical consumers of the travel device that will be described by way of example in the following.

The travel device can thus have a sensor system for determining the flow speed and/or the direction of flow of the fluid flowing around. The direction of flow can, for example, be determined by means of pressure sensors via a determination of the maximum back pressure and the flow speed can be determined via a differential pressure measurement.

Further advantageously, the travel device can moreover have a navigation system for determining its position and/or orientation relative to the surface of the body to be traveled over by it. Such sensor systems serve to enable the travel device to make an efficient and autonomous or semiautonomous movement. The navigation system can, for example, be enabled to carry out a distance measurement and/or a determination of the travel speed of the travel device by odometry using operating data of the traction system, for instance from a measurement of the revolution speed of a wheel axle. The navigation system can furthermore comprise accelerometers, gyroscopes, and/or a compass to determine the position, location, and travel movement of the travel device. The surface of the body traveled over can, for example, have boundary markers, guide markers, and/or induction loops, with the navigation system being configured for their identification by means of an optical measuring unit and/or induction sensors.

The travel device in accordance with the invention can in particular have a cleaning system and/or an inspection system and/or a maintenance system for cleaning and/or inspecting and/or maintaining the surface of the body. The cleaning system, for example, comprises rotatable brushes or high pressure water jet nozzles. The inspection system can be formed by a camera, for instance in combination with an illumination unit, and/or can have a special appropriate sensor system, for example based on ultrasound. An inspection system can be used, for example, having a camera for preparing a total image of the surface of the body traveled over, for which purpose a plurality of individual images captured on the traveling over by the camera can be linked to form a corresponding total representation. The maintenance of the surface of the body traveled over can in particular include maintenance work such as grinding or welding, for which purpose the maintenance system of the travel device is to be configured in an appropriate manner.

The travel device, for example, has a mechanical cleaning system and a transmission, with the traction system being operatively connected to the drive of the transmission and the cleaning system being operatively connected to the output of the transmission so that the cleaning system is operable on the travel movement of the travel device by means of the transmission, for instance such that a cleaning brush can be set into rotation, with the work required for this purpose being suppliable from the traction system by means of the transmission.

in an advantageous embodiment, the travel device has a control system for autonomous or semiautonomous operation. The operation here preferably comprises both the targeted movement on the surface and the carrying out of worksteps such as in particular cleaning or inspection. The control system can in particular control all the further systems of the travel device and preferably also comprises a communication module for wireless communication, for example with a device on board a vessel traveled over by the travel device.

The rotor blades of wind turbines, for example, represent a further area of application for the travel device in accordance with the invention in addition to the use on the surface of hulls. They require regular cleaning since fouling and in particular adhering insects result in an unwanted increase in resistance, a reduction of buoyancy, and a generation of noise. A further application example can be the internal traveling over of pipelines flowed through by fluid for purposes of cleaning, maintenance, or inspection. The detailed configuration and dimensioning of the travel device and in particular of the drive system here have to be respectively appropriately adapted to the application addressed.

The present invention further relates to a method of cleaning and/or inspecting and/or maintaining the surface of a body flowed around by a fluid, in particular a hull, a rotor blade, a rudder, a pipe member, or the like, with at least one travel device in accordance with the invention being traveled in accordance with one of the aforesaid embodiments over the surface of the body flowed around by the fluid while carrying out cleaning and/or inspection and/or maintenance measures, with flow energy being taken from the fluid flowing around for the movement of the travel device and being used for the drive of the travel movement.

A plurality of travel devices can in particular be used simultaneously here, with the travel devices cooperating with one another in the carrying out of the cleaning and/or inspection and/or maintenance measures. The travel devices can, for example, communicate with one another over radio connections and can effectively carry out the respective measures as an autonomous group or by means of a central control.

BRIEF DESCRIPTION OF THE DRAWINGS

Further measures improving the invention will be shown in more detail below together with the description of preferred embodiments of the invention with reference to the Figures. There are shown.

DETAILED DESCRIPTION OF THE INVENTION

Figure 1A:
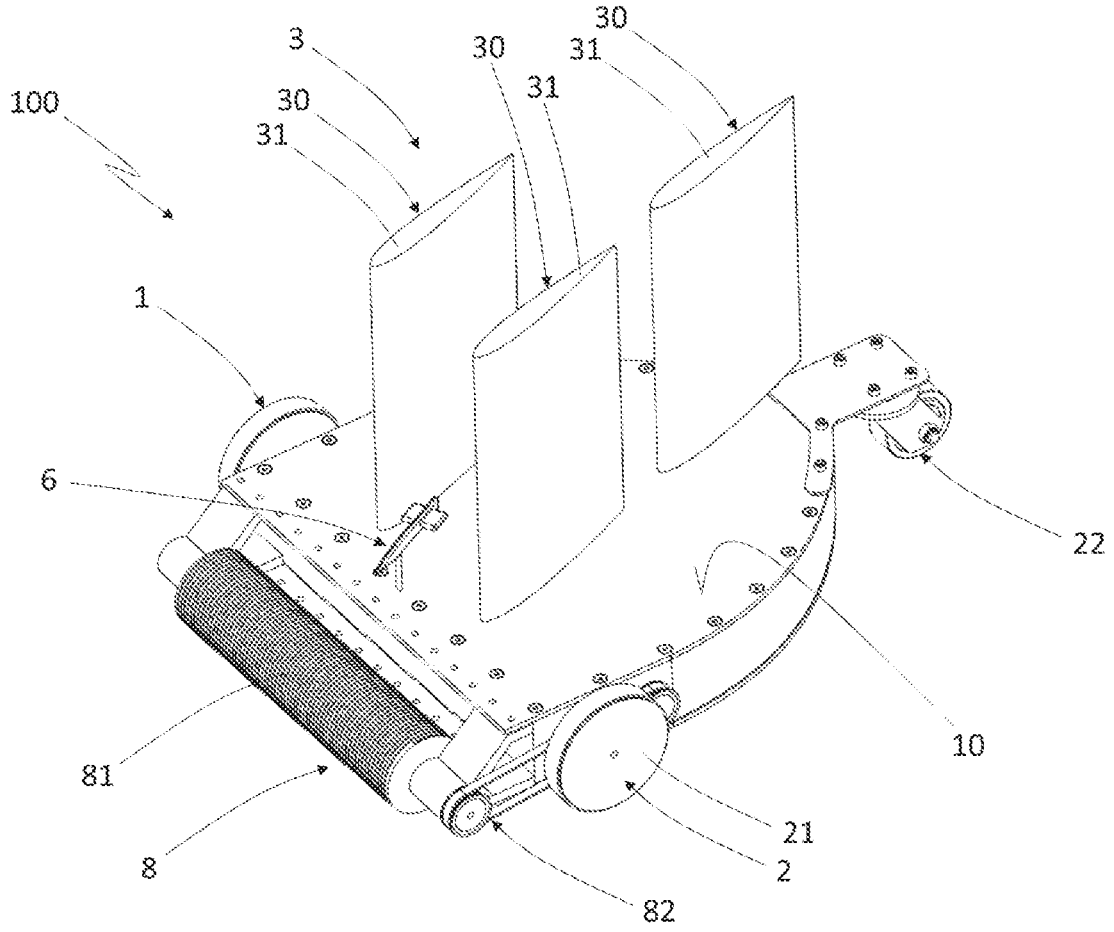
FIGS. 1*a, b* perspective views of a first embodiment of the travel device in accordance with the invention.
Figure 1B:
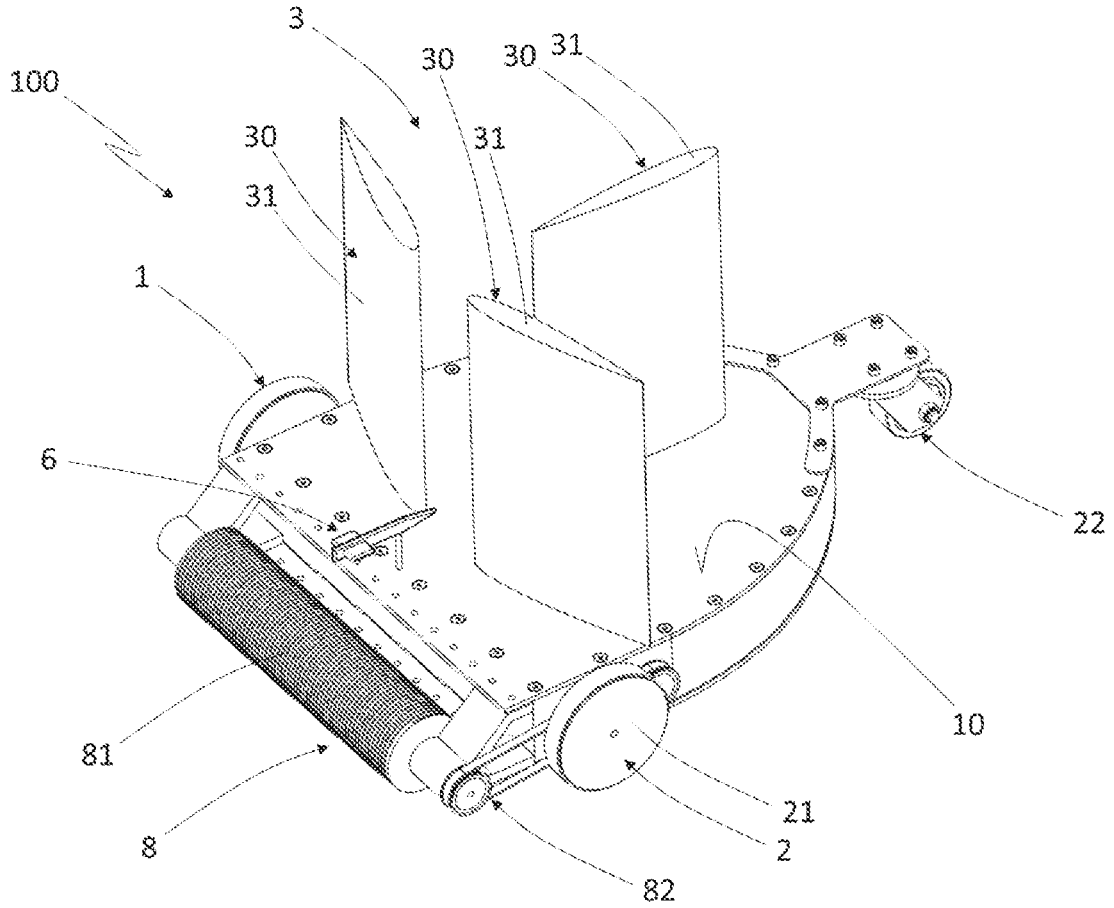
FIG. 1*c* a perspective view of the first embodiment without a cover.

FIG. 1*a* and FIG. 1*b* show perspective views of a first embodiment of the travel device 100 in accordance with the invention that is in particular suitable for use on the surface of a hull. The drive system 3 has three flow bodies 30 arranged spaced apart from one another that are formed as vane members 31 having a symmetrical profile and that project from the upper side 10 of the travel device 100 at a perpendicular vertical angle. On a use on a hull, the upper side 10 is remote from its surface so that the vane members 31 are flowed onto by the water flowing around the hull below the waterline.

The travel device 100 furthermore has a traction system 2 for fixing the course on the surface to be traveled on that comprises the two laterally oppositely disposed drive wheels 21 and the rear pivot wheel 22. The drive wheels 21 circumferentially have a permanent magnetic section, for example composed of an iron metal/rare earth alloy, whereby the holding system 1 is formed that enables the travel device 100 to adhere to a magnetizable body surface, here in particular a hull.

At the front side, the travel device 100 has the cleaning system 8 that comprises the cylindrical brush 81 that is drivable to rotate via the belt transmission 82. The brush 81 is in particular provided to clean a hull surface from organic fouling.

The travel device 100 furthermore comprises the sensor system 6 for determining the flow speed and/or the direction of flow of a fluid flowing around, in particular of water flowing around. The data logged by the sensor system 6 serve the setting of the drive system 3 appropriate for movement.

Respective different positions of the vane members 31 are shown in FIG. 1*a* and FIG. 1*b* that are appropriate for different orientations of the travel device 100 relative to a fluid flowing around, with a travel movement of the travel device 100 in the direction of the cleaning system 8 being respectively aimed for. Analogously to the positions of the sails of a sailing vessel or of a sand yacht, the position of the vane members 31 shown in FIG. 1*a* would correspond to a course "upwind" and a course "before the wind" is correspondingly shown in FIG. 1*b*. The vane members 31 are each rotatable about a vertical axis of rotation to change the position that extends, for instance, in the region of the greatest thickness of the profile of the vane member 31.

Figure 1C:
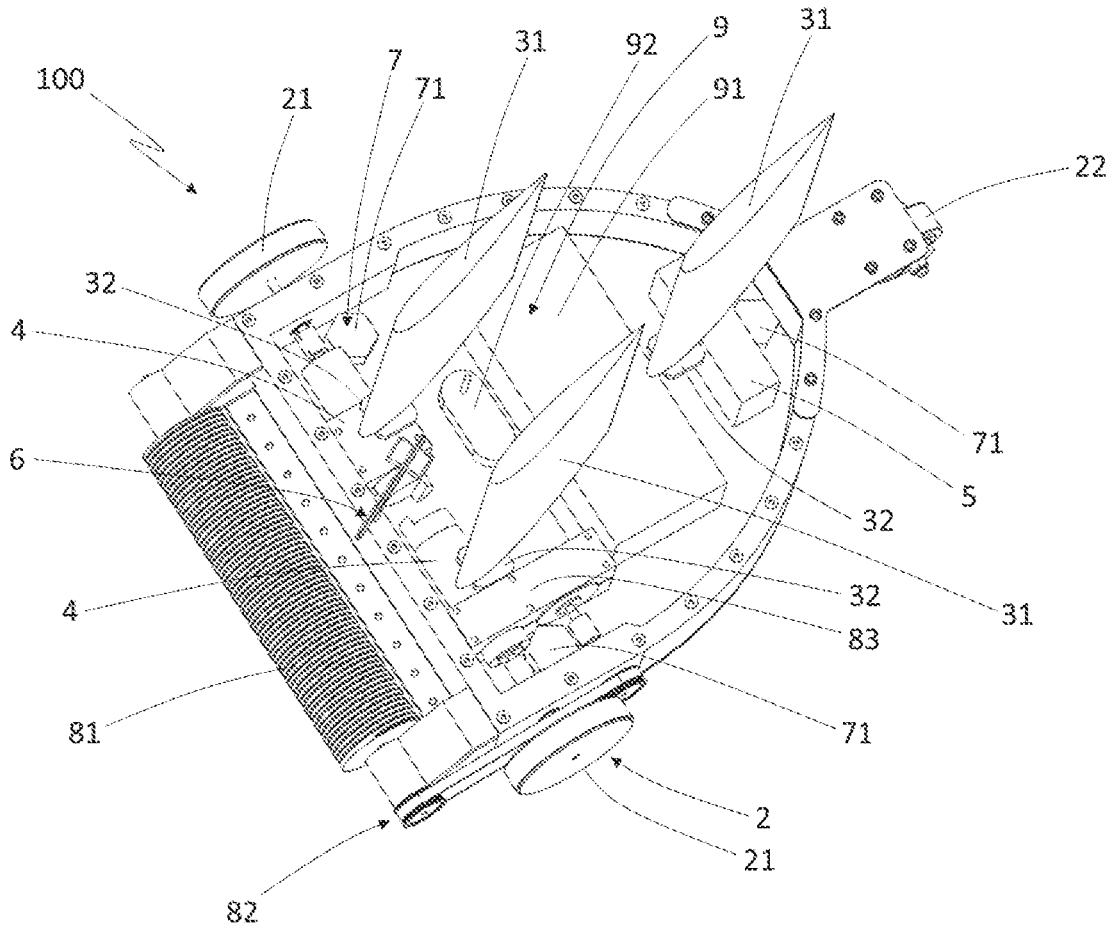

FIG. 1*c* shows a further perspective view of the first embodiment without a cover so that the housing interior of the travel device 100 is exposed to view. The closed housing is appropriately sealed against water ingress for operation underwater.

The respective setting elements 32 by means of which the angle of attack of the vane members 31 in a fluid flowing around can be set are arranged below the axes of rotation of the vane members 31.

The travel device 100 further has the two electric machines 4 and the storage battery 5 electrically connected thereto (all the required cable connections between the various components are not shown here for reasons of clarity), with the electric machines 4 being operatively connected to the traction system 2, i.e. to the two drive wheels 21, so that the electric machines 4 are configured for interaction with the traction system 2 in motor operation and/or in generator operation. The operating mode of the electric machines can be switched between "motor" and "generator", in particular by means of a control by the control system 9. On the movement of the travel device 100 by means of the vane members 31 in a fluid flowing around, the rotation energy of the rolling drive wheels 21 can therefore be converted into electric energy by means of the electric machines 4 in generator operation and can be used for charging the storage battery 5. The electric supply of all the components of the travel device 100 takes place by means of the storage battery 5. In motor operation, the electric machines 4 act to drive the drive wheels 21 so that the travel device 100 is enabled also to move outside a fluid flowing around.

The brush 81 is drivable to rotate via the belt transmission 82, with drive energy being able to be taken from the traction system 2 by means of the transmission 83. The drive of the transmission 83, that can in particular be configured as a spur gear, is operatively connected to the traction system 2, i.e. to the axle of the drive wheel 21, and the output of the transmission 83 forms the drive of the belt transmission 82. Alternatively or additionally, a separate motor can be provided to drive the brush 81.

The travel device 100 furthermore comprises the navigation system 7 with the three position sensors 71 for determining the position and orientation of the travel device 100.

The control system 9 comprises the control unit 91 and the radio module 92 and serves the carrying out of an autonomous or semiautonomous operation of the travel device 100. The control unit 91 is electrically connected in a manner not shown to the components of the sensor system 6, of the navigation system 7, of the electric machine 4, of the setting elements 32, and optionally to further electrical onboard systems, for example to an additional motor to drive the brush. Based on the data of the sensor system 6 and of the navigation system 7, the control unit 91 can fix the route to be traveled by the travel device 100 and can output corresponding control commands to the setting elements 32 for an appropriate setting of the vane members 31. The radio module 92 serves the communication with an external control and/or, for example, with further cooperating travel devices in accordance with the invention.

Figure 2:
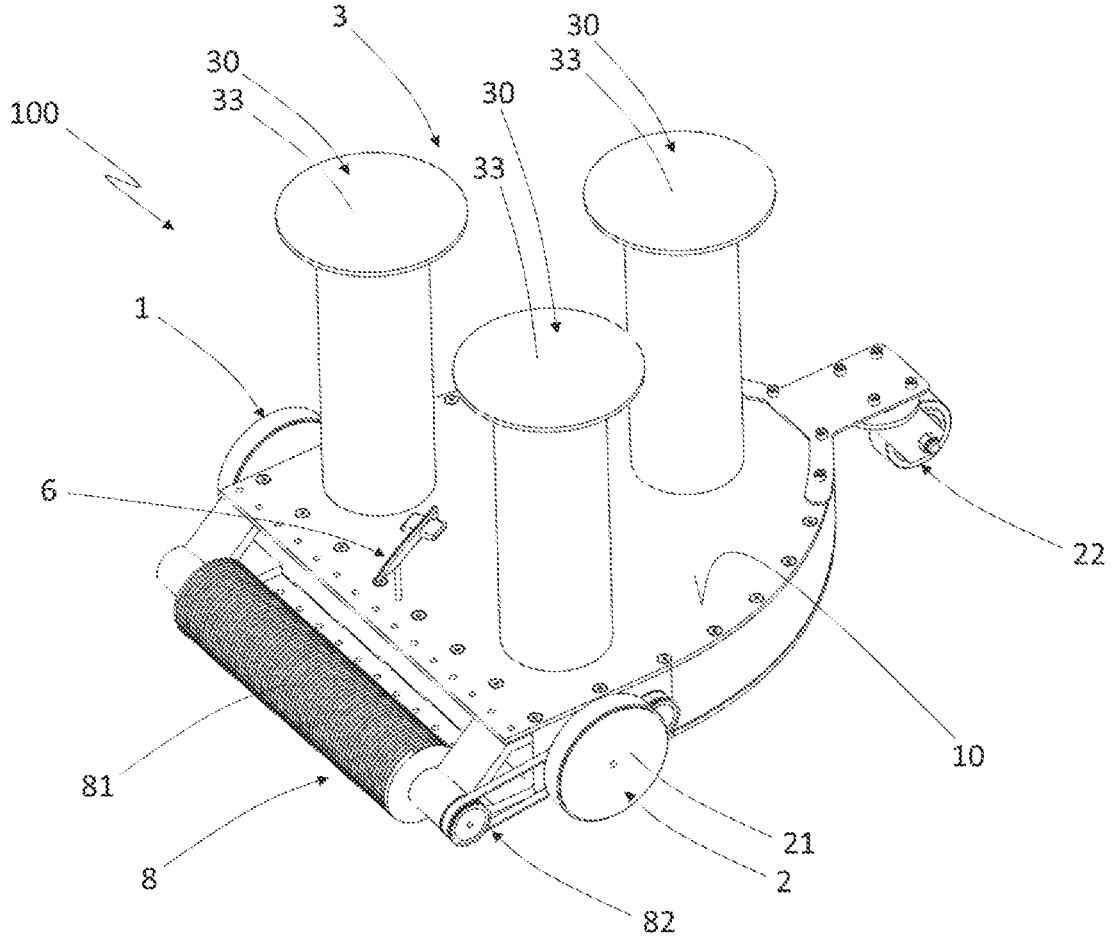
FIG. 2 a perspective view of a second embodiment.

FIG. 2 shows a perspective view of a second embodiment of the travel device 100 in accordance with the invention in which the flow bodies 30 of the drive system 3 are formed as Flettner rotors 33. The associated rotor drives for the rotation of the Flettner rotors 33 are arranged in a non-visible manner here in the interior of the housing of the travel device 100. The maneuverability of the embodiment shown results from the fact that the individual Flettner rotors 33 can be rotated at different rotation speeds so that a torque can be generated to steer or turn the travel device 100 in a fluid flowing around.

Figure 3:
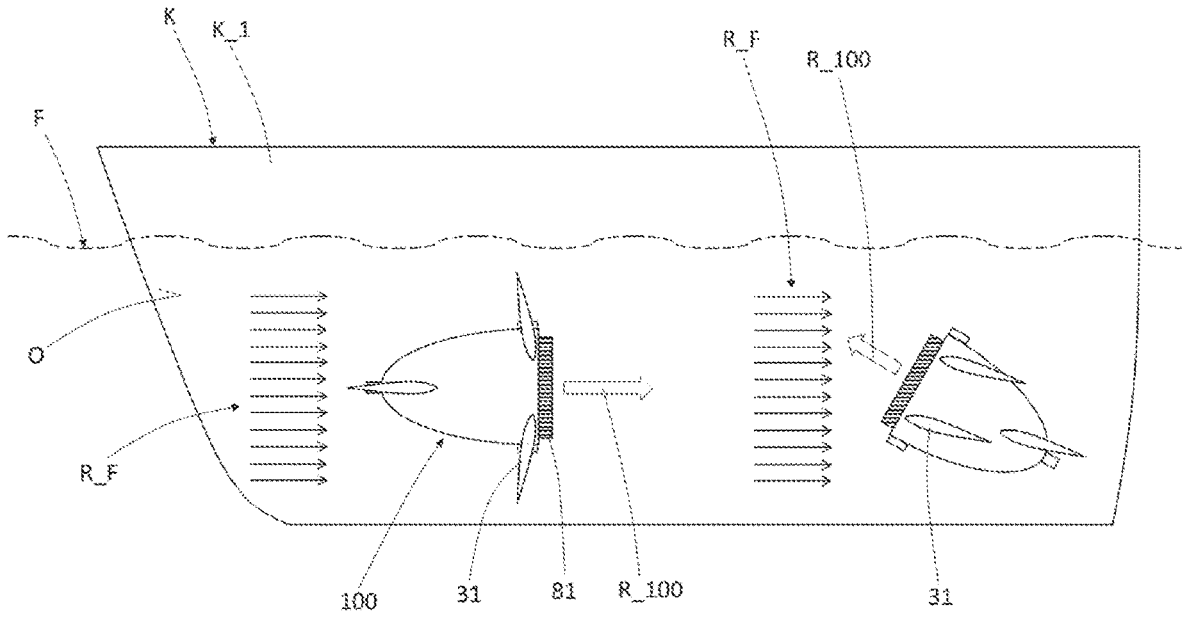
FIG. 3 schematic representations of a travel device in accordance with the invention on a hull.

FIG. 3 shows schematic representations of a travel device 100 in accordance with the invention in accordance with the first embodiment of FIGS. 1*a* to 1*c* on the surface O of a body K in the form of a hull K_1 flowed around by the fluid F in the form of water, with the travel device 100 being respectively located below the waterline, indicated by a dashed line, and being flowed around by the Fluid F from the direction of flow R_F. The travel direction R_100 of the travel device 100 is here aligned in parallel in the left image and in the direction of flow R_F, with the position of the vane members 31 being optimized for propulsion by flow resistance force. In the representation of the right part of the image, the direction of travel R_100 of the travel device 100 has a main component against the direction of flow R_F and the position of the vane members 31 is accordingly directed to the generation of dynamic buoyancy.

Figure 4:
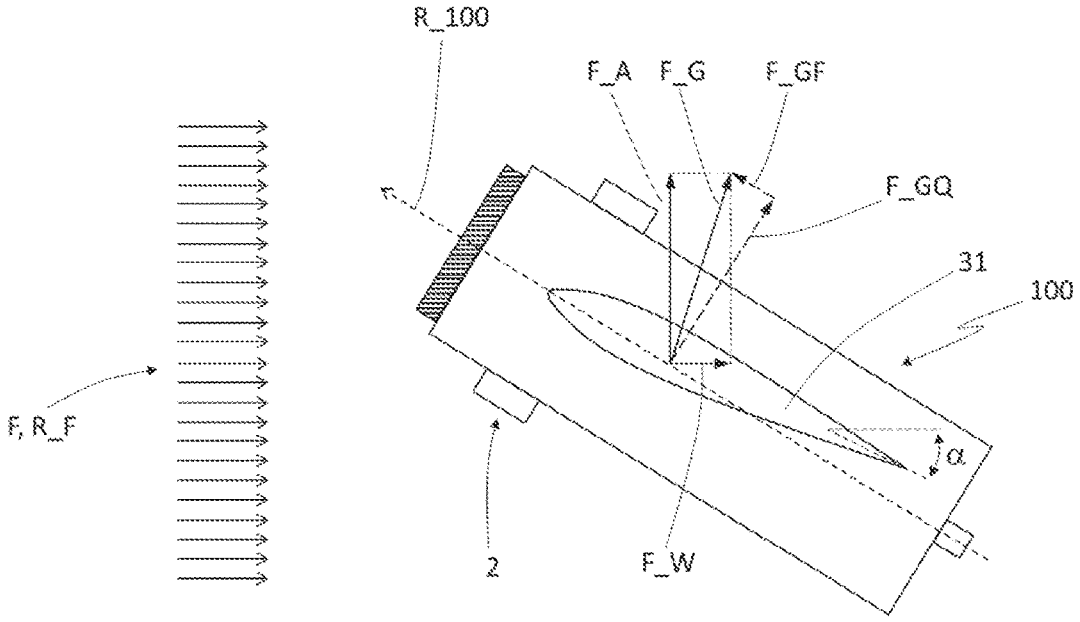
FIG. 4 a schematic representation to illustrate the relevant forces.

FIG. 4 shows a schematic representation to illustrate the relevant fluid dynamic forces that engage at the travel device 100, in particular at a vane member 31, in a fluid F flowing around. A travel device 100 is shown whose direction of travel R_100 has a significant component against the direction of flow R_F. The total fluid dynamic force F_G applied to the vane member 31 is composed of the flow resistance force F_W in the direction of flow R_F and of the dynamic buoyancy F_A perpendicular to the direction of flow R_F. A breaking down of the total force F_G with respect to the direction of travel R_100 produces the force F_GQ in the transverse direction that is taken up by the traction system 2 of the travel device 100 and the force F_GF that acts in the direction of travel R_100 and provides the propulsion of the travel device 100 with a main component against the fluid F flowing around. The ratio of the flow resistance force F_W to the dynamic buoyancy F_A can be changed by varying the angle of attack $\alpha$ between the chord of the vane member 31 and the direction of flow R_F and is additionally dependent on the specific profile of the vane member 31.

The invention is not restricted in its design to the preferred embodiments specified above. A number of variants is rather conceivable that also makes use of the solution shown with generally differently designed embodiments. All the features and/or advantages, including any construction details or spatial arrangements, originating from the claims, the description, or the drawings can be essential to the invention both per se and in the most varied combinations.

REFERENCE NUMERAL LIST

100 travel device
10 upper side
1 holding system
2 traction system
21 drive wheel
33 pivot wheel
3 drive system
30 flow body
31 vane member
32 setting element
33 Flettner rotor
4 electric machine
5 storage battery
6 sensor system
7 navigation system
71 position sensor
8 cleaning system

81 brush
82 belt transmission
83 transmission
9 control system
91 control unit
92 radio module
F fluid
K body
O body surface
K_1 hull
R_100 direction of travel
R_F direction of flow
α angle of attack
F_A dynamic buoyancy
F_W flow resistance force
F_G total fluid dynamic force
F_GF force in the direction of travel
F_GQ force in the transverse direction

The invention claimed is:

1. A travel device for movement on the surface of a body flowed around by a fluid, the travel device comprising:

a holding system for adhesion of the travel device to the surface;

a traction system for fixing a course of the travel device on the surface; and a drive system for driving a travel movement of the travel device on the surface, the drive system having at least one flow body that can be flowed around for interaction with the fluid so that flow energy can be taken from the fluid flowing around for the movement of the travel device on the surface of the body flowed around by the fluid and the flow energy is usable for the drive of the travel movement, wherein the drive system is configured such that flow energy taken from the fluid flowing around by momentum transfer onto the at least one flow body for the movement of the travel device is usable for a direct fluid dynamic drive of the travel movement, and wherein the travel device is free of mechanical connections to external drive means and/or external retaining means.

2. The travel device according to claim 1, wherein the drive system is configured for interaction with the fluid such that the travel movement of the travel device is in particular exclusively drivable by a dynamic buoyancy and/or by flow resistance force.

3. The travel device according to claim 1, wherein the travel device is drivable on the surface of the body flowed around by the fluid by the drive system to make a travel movement whose direction of travel comprises a significant component, in particular a main component, against the direction of flow of the fluid.

4. The travel device according to claim 1, wherein the at least one flow body is a vane member and the drive system has at least one setting element, an angle of attack of the vane member being settable in the fluid flowing around by the setting element.

5. The travel device according to claim 4, wherein the vane member has an asymmetrical profile.

6. The travel device according to claim 4, wherein the vane member has an actively or passively variable profile.

7. The travel device according to claim 1, wherein the travel device has a planar extent of 0.05 square meters up to 1.5 square meters and the vane member has a planar extent of 0.02 square meters up to 0.75 square meters.

8. The travel device according to claim 1, wherein the at least one flow body is a Flettner rotor and the drive system has at least one rotor drive, the Flettner rotor being rotatable by the rotor drive.

9. The travel device according to claim 1, wherein the at least one flow body is extendable so that a size of interaction surfaces that can be flowed around can be set.

10. The travel device according to claim 1, wherein the at least one flow body is pivotable so that a vertical angle of the at least one flow body toward an upper side of the travel device is settable.

11. The travel device according to claim 1, wherein the at least one flow body is inwardly foldable into a position of minimal flow resistance and/or a position of minimal extent perpendicular to an upper side of the travel device.

12. The travel device according to claim 1, wherein at least one flow body of the drive system comprises a plurality of flow bodies.

13. The travel device according to claim 1, further comprising at least one electric machine and at least one storage battery electrically connected thereto, the electric machine being operatively connected to the traction system so that the electric machine is configured for interaction with the traction system in motor operation and/or in generator operation.

14. The travel device according to claim 1, further comprising a sensor system for determining a flow speed and/or a direction of flow of the fluid flowing around.

15. The travel device according to claim 1, further comprising a navigation system for determining a position and/or an orientation relative to the surface of the body.

16. The travel device according to claim 1, further comprising a cleaning system and/or an inspection system and/or a maintenance system for cleaning and/or inspecting and/or maintaining, respectively, the surface of the body.

17. The travel device according to claim 16, wherein the travel device has a mechanical cleaning system and a transmission, the traction system being operatively connected to a drive of the transmission and the mechanical cleaning system being operatively connected to the output of the transmission so that the mechanical cleaning system is operable by the transmission on the travel movement of the travel device.

18. The travel device according to claim 1, further comprising a control system for autonomous or semiautonomous operation of the travel device.

19. A method of cleaning and/or inspecting and/or maintaining a surface of a body flowed around by a fluid, the method comprising:

providing at least one travel device according to claim 1;

travelling the at least one travel device over the surface of the body flowed around by the fluid while carrying out cleaning and/or inspection and/or maintenance measures; and taking flow energy from the fluid flowing around for movement of the travel device and using the flow energy to drive the travel movement.

20. The method according to claim 19, wherein:

the at least one travel device comprises a plurality of travel devices; and the plurality of travel devices are used simultaneously, with the travel devices cooperating with one another in the carrying out of the cleaning and/or inspection and/or maintenance measures.

* * * * *